US009919181B1

(12) United States Patent
Lee

(10) Patent No.: US 9,919,181 B1
(45) Date of Patent: Mar. 20, 2018

(54) DETACHABLE KINETIC CHAIN ENERGY MOVEMENT BOARD FOR POSTURE WHEN USING PILATES REFORMER

(71) Applicant: Sang Gon Lee, Gyeonggi-do (KR)

(72) Inventor: Sang Gon Lee, Gyeonggi-do (KR)

( * ) Notice: Subject to any disclaimer, the term of this patent is extended or adjusted under 35 U.S.C. 154(b) by 0 days.

(21) Appl. No.: 15/408,043

(22) Filed: Jan. 17, 2017

(30) Foreign Application Priority Data

Jan. 5, 2017 (KR) ..... 10-2017-0001854

(51) Int. Cl.
*A63B 22/00* (2006.01)
*A63B 21/00* (2006.01)
*A63B 21/04* (2006.01)
*A63B 23/04* (2006.01)

(52) U.S. Cl.
CPC ..... *A63B 21/4034* (2015.10); *A63B 21/0428* (2013.01); *A63B 21/4045* (2015.10); *A63B 22/0089* (2013.01); *A63B 23/04* (2013.01)

(58) Field of Classification Search
None
See application file for complete search history.

(56) References Cited

U.S. PATENT DOCUMENTS 5,499,958 A * 3/1996 Hess ..... A63B 21/0552 482/123
6,042,523 A * 3/2000 Graham ..... A63B 21/0552 482/121
6,527,685 B2 * 3/2003 Endelman ..... A63B 21/023 482/121
6,971,976 B2 * 12/2005 Endelman ..... A63B 21/023 482/121
7,803,095 B1 * 9/2010 LaGree ..... A63B 22/0089 482/121
8,485,952 B2 * 7/2013 Gehrke ..... A47C 20/021 482/130
8,641,585 B2 * 2/2014 LaGree ..... A63B 21/023 482/92
8,668,632 B2 * 3/2014 Ellis ..... A63B 21/0442 482/130
8,721,511 B2 * 5/2014 Endelman ..... A63B 21/156 482/121
9,108,079 B2 * 8/2015 Solow ..... A63B 21/055
D802,687 S * 11/2017 Diallo ..... D21/668
2015/0065320 A1 * 3/2015 Anderson ..... A63B 21/0428 482/142

FOREIGN PATENT DOCUMENTS

KR 10-2014-0037148 A 3/2014

* cited by examiner

*Primary Examiner* — Stephen R Crow
(74) *Attorney, Agent, or Firm* — Novick, Kim & Lee, PLLC; Jae Youn Kim

(57) ABSTRACT

Provided is a detachable kinetic chain energy movement (KEM) board for posture when using a Pilates reformer. The KEM board is configured to be detachably mounted to a foot bar or a footstool board of the Pilates reformer in order to provide flexion and extension, which are not conventionally possible, wherein the KEM board is configured to be easily and conveniently mounted to and detached from all kinds of Pilates reformers, is configured to derive much better muscle exercise effects during reformer exercises through the motion of the ankle and the hip joint within a full range of motion (ROM) and elastic resistance, and is configured to enable various kinds of exercises to be performed.

7 Claims, 11 Drawing Sheets

-PRIOR ART-

-PRIOR ART-

-PRIOR ART-

DETACHABLE KINETIC CHAIN ENERGY MOVEMENT BOARD FOR POSTURE WHEN USING PILATES REFORMER

BACKGROUND OF THE INVENTION

Field of the Invention

The present invention relates to a detachable kinetic chain energy movement (KEM) board for posture when using a Pilates reformer, which is configured to be detachably mounted to a foot bar or a footstool board of the Pilates reformer in order to provide flexion and extension, which are not conventionally possible, wherein the KEM board is configured to be easily and conveniently mounted to and detached from all kinds of Pilates reformers, is configured to derive much better muscle exercise effects when performing reformer exercises through the motion of the ankle and the hip joint within a full range of motion (ROM) and elastic resistance, and is configured to enable various kinds of exercises to be performed.

Description of the Related Art

Physical exercises invented by Joseph Pilates are performed using a stationary device called a reformer.

A conventional reformer includes a rectangular wood or metal frame for supporting two parallel rails or tracks.

A wheeled carriage is disposed on the tracks such that the carriage is elastically connected to the foot end of the frame via one or more elastic members, such as coil springs.

A user pushes a foot support bar, which is located at the foot end of the frame, in the state of sitting or lying on the carriage such that the carriage is moved away from the foot end of the frame or is moved toward the foot end of the frame.

Selectively, the user may pass through a pulley, which is located at the end of a head of the frame, and may hold the ends of a pair of ropes or straps, which are attached to the carriage. In this state, the user may pull the ropes or straps such that the carriage is moved away from the foot end of the frame or is moved toward the foot end of the frame.

That is, the reformer enables the user to perform an extension exercise, which is related to a leg press. Consequently, the reformer has been widely used as an exercise device that is capable of rehabilitating various portions of the body of the user, such as the legs, the arms, and the trunk, or increasing muscular strength.

As shown in FIG. 11, however, the conventional reformer is configured such that the feet of the user are fixed to a footstool, which is located at the foot end of the frame. For this reason, the hip joint cannot be sufficiently flexed and extended while exercising. The reason for this is that the structure of the reformer is not configured to sufficiently flex and extend the hip joint while exercising using a bar or a footstool board. For example, the bar is located above the feet of the user.

In addition, in the case in which the foot end of the conventional reformer is a horizontal bar or a footstool pad, the positions of the feet are fixed, with the result that the full range of motion (ROM) through which the ankle and the hip joint are movable is limited, whereby it is not possible to perform various kinds of exercises.

In addition, it is ideal that the weight of a human being is distributed to the calcaneus and to lateral and sesamoid in a ratio of 50:50 in the state in which the human being is standing up. In the footstool of the conventional reformer, however, the heel is lifted when a full squat is performed, with the result that the center of gravity of the foot is concentrated on the lateral and sesamoid. For this reason, it is not possible to train people to appropriately adjust the center of gravity of the foot for proper posture.

In addition, since the feet are fixed to the footstool of the conventional reformer, as shown in FIG. 12, the front part of the ankle may be wrenched when the user sits down deeply. As a result, the heel is separated from the footstool, whereby the weight of the user is concentrated on the lateral and sesamoid.

Furthermore, in the conventional reformer, the heel must be lifted in order to stably perform a full squat, as shown in FIG. 13. In this case, however, a load is applied to the joint (for example, a load is applied to the joint, and therefore it is not possible to train people to appropriately adjust the center of gravity of the foot and to use a stable ground reaction force).

SUMMARY OF THE INVENTION

Therefore, the present invention has been made in view of the above problems, and it is an object of the present invention to provide a detachable kinetic chain energy movement (KEM) board for posture when using a Pilates reformer, which is configured to be detachably mounted to a foot bar or a footstool board of the Pilates reformer in order to provide flexion and extension, which are not conventionally possible, wherein the KEM board is configured to be easily and conveniently mounted to and detached from all kinds of Pilates reformers, is configured to derive much better muscle exercise effects during reformer exercises through the motion of the ankle and the hip joint within a full range of motion (ROM) and elastic resistance, and is configured to enable various kinds of exercises to be performed.

In accordance with the present invention, the above and other objects can be accomplished by the provision of a detachable kinetic chain energy movement (KEM) board for posture when using a Pilates reformer, the KEM board including a board main body provided in one side and the other side of the front surface thereof with sliding grooves for movement in the leftward-rightward direction, the sliding grooves extending so as to be parallel to each other in the horizontal direction, the board main body being provided on one side and the other side of the rear surface thereof with fastening members, which are detachably fastened to a foot bar or a footstool board of the Pilates reformer, the board main body being provided in the interior thereof with a space part, the space part being provided in each lateral side end thereof with a fixing member, by which one end of a first elastic member is supported, the fixing members being provided in a symmetrical fashion, slides, each of the slides being provided at one side and the other side thereof with support members, which are inserted into the respective sliding grooves such that the support members are movable in the leftward-rightward lateral direction, each of the support members being provided at one side thereof in the leftward-rightward lateral direction with a connection plate, the horizontal axis of which is aligned with the horizontal axis of the fixing member and to which the other end of the first elastic member is fixed, a vertical bar, which is provided with an upward-downward moving rail, being formed at a protruding front surface of each of the support members, a bracket, to which one end of a second elastic member is fixed, being formed at each side of the upper end of the vertical bar, and foot pads, each of the foot pads being provided at one side thereof with a moving block, which is inserted into the moving rail so as to be movable upward and downward, a footstool, on which a foot is located, being formed at a protruding front surface of the moving block, the footstool being provided at each end thereof in the leftward-rightward lateral direction with a catching member, the vertical axis of which is aligned with the vertical axis of the bracket and to which the other end of the second elastic member is connected.

Each of the fastening members of the board main body may be of any one selected from among a hook catching type, a Velcro attachment type, a button fastening type, a screw fixing type, and a rubber band binding type.

In addition, in a selective embodiment, each of the fastening members of the board main body may include a hook ring, at one side of which a clamp is formed, a straight portion of the hook ring being mounted in the outermost one of a multistage telescopic withdrawal box, i.e. the outermost withdrawal box, clamps being formed at one side of the multistage telescopic withdrawal box such that, when the withdrawal height or distance of the straight portion of the hook ring or the outermost withdrawal box is set, the clamps clamp or unclamp the straight portion of the hook ring or the outermost withdrawal box at arbitrary positions in order to fix or unfix each of the fastening members.

The first elastic member and the second elastic member may be made of any one selected from among a coil spring, a rubber band, and an elastic synthetic resin string, and the first elastic member and the second elastic member are formed so as to have low, middle, and high degrees of tension such that each of the first elastic member and the second elastic member is interchangeable.

In addition, in a selective embodiment, each of the foot pads may include a foot pedal coupled to the upper surface of the footstool, the foot pedal being provided on the surface thereof opposite the surface that the foot contacts with a fixing rib having therein an assembly hole, a hinge pin being coupled through the assembly hole such that the horizontal axis of an upper connection hole formed in a shaft, which extends from the footstool after having been assembled with the footstool, is aligned with the horizontal axis of the assembly hole, whereby the foot pedal performs a forward-rearward seesaw motion about the hinge pin with respect to the footstool.

In a selective embodiment, the foot pedal may be formed such that the shaft is rotatable in the circumferential direction in the state of being supported by a bearing, whereby it is possible to perform an arc rotation motion of the feet, including a motion of closing the feet or a motion of opening the feet, in addition to a parallel motion of the feet.

In a selective embodiment, the shaft may be provided in the side surface thereof that is assembled to the footstool with a fixing hole, the fixing hole being formed so as to communicate with an insertion hole formed in the footstool, whereby circumferential rotation of the shaft, performed in the state of being supported by the bearing is prevented when a stopper pin, is inserted into the fixing hole via the insertion hole.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
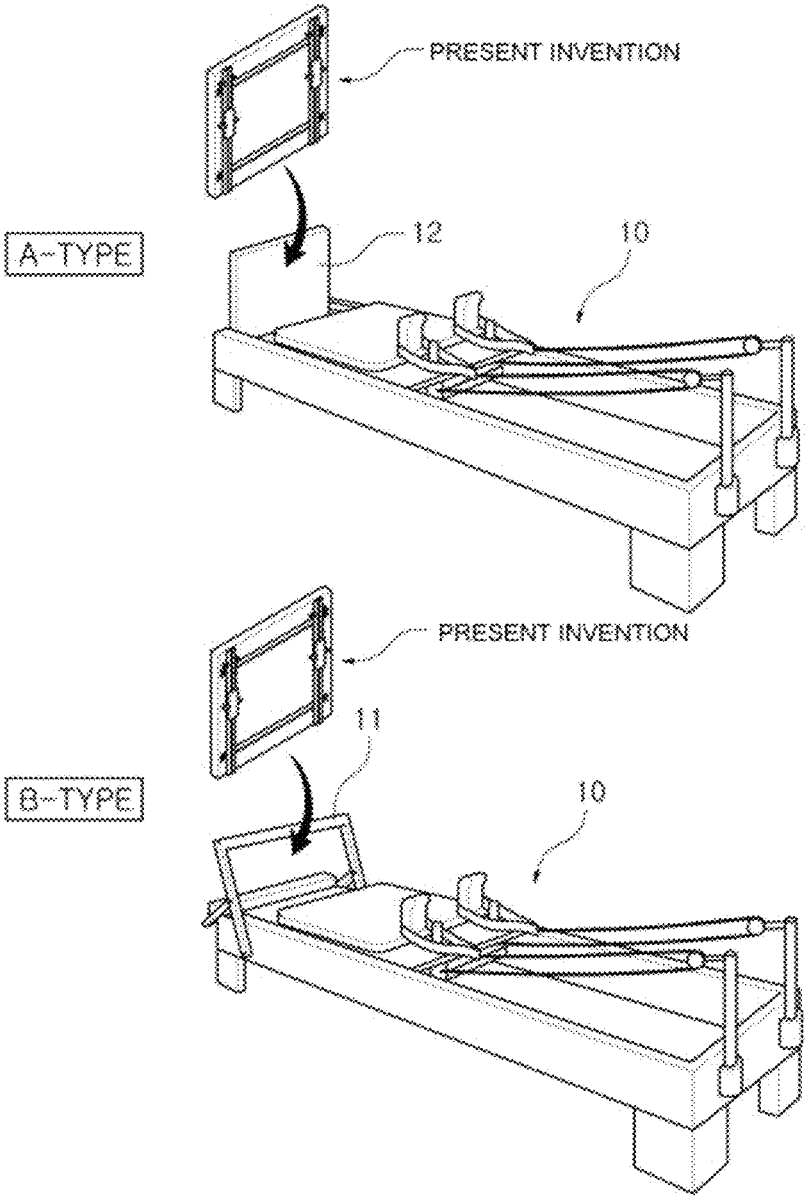
FIG. 1 is a view illustrating a Pilates reformer, to which a foot board according to the present invention is applied.
Figure 2:
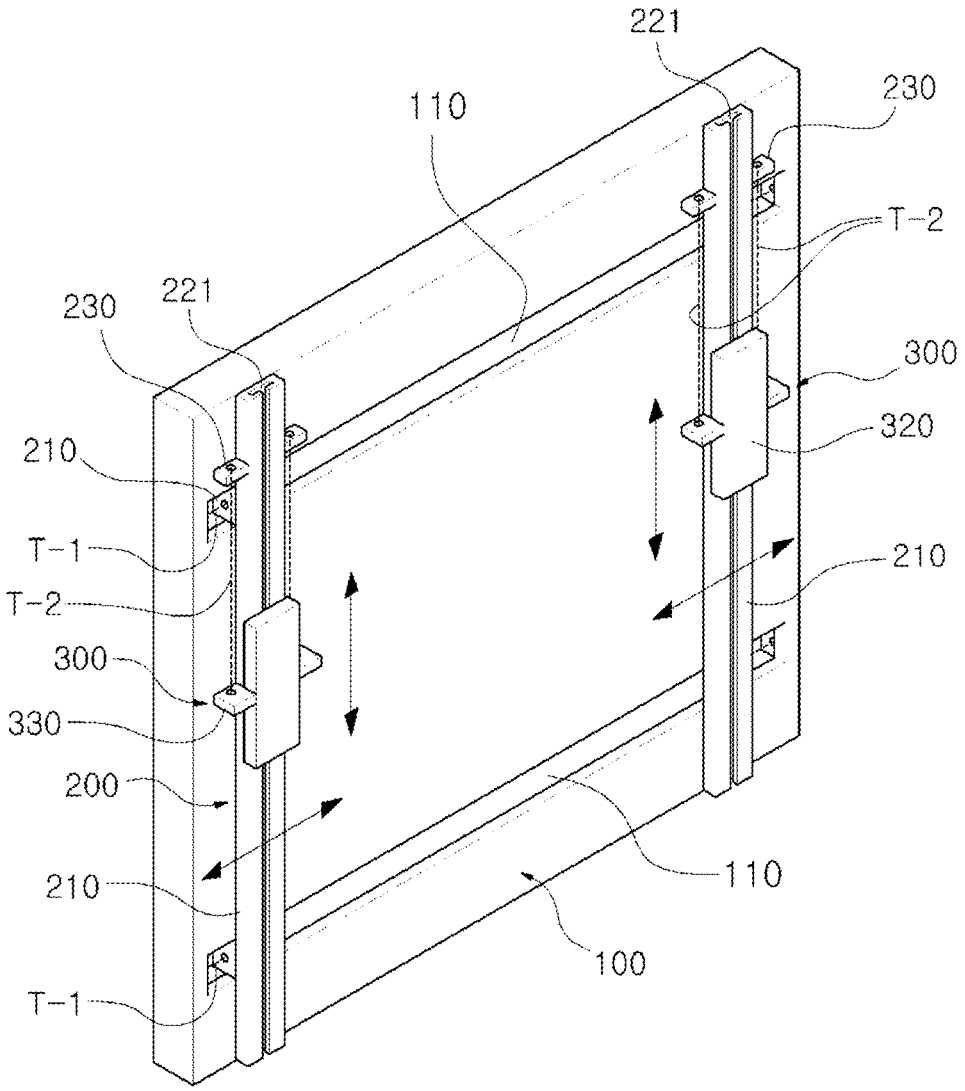
FIG. 2 is a front perspective view illustrating the foot board according to the present invention.
Figure 3:
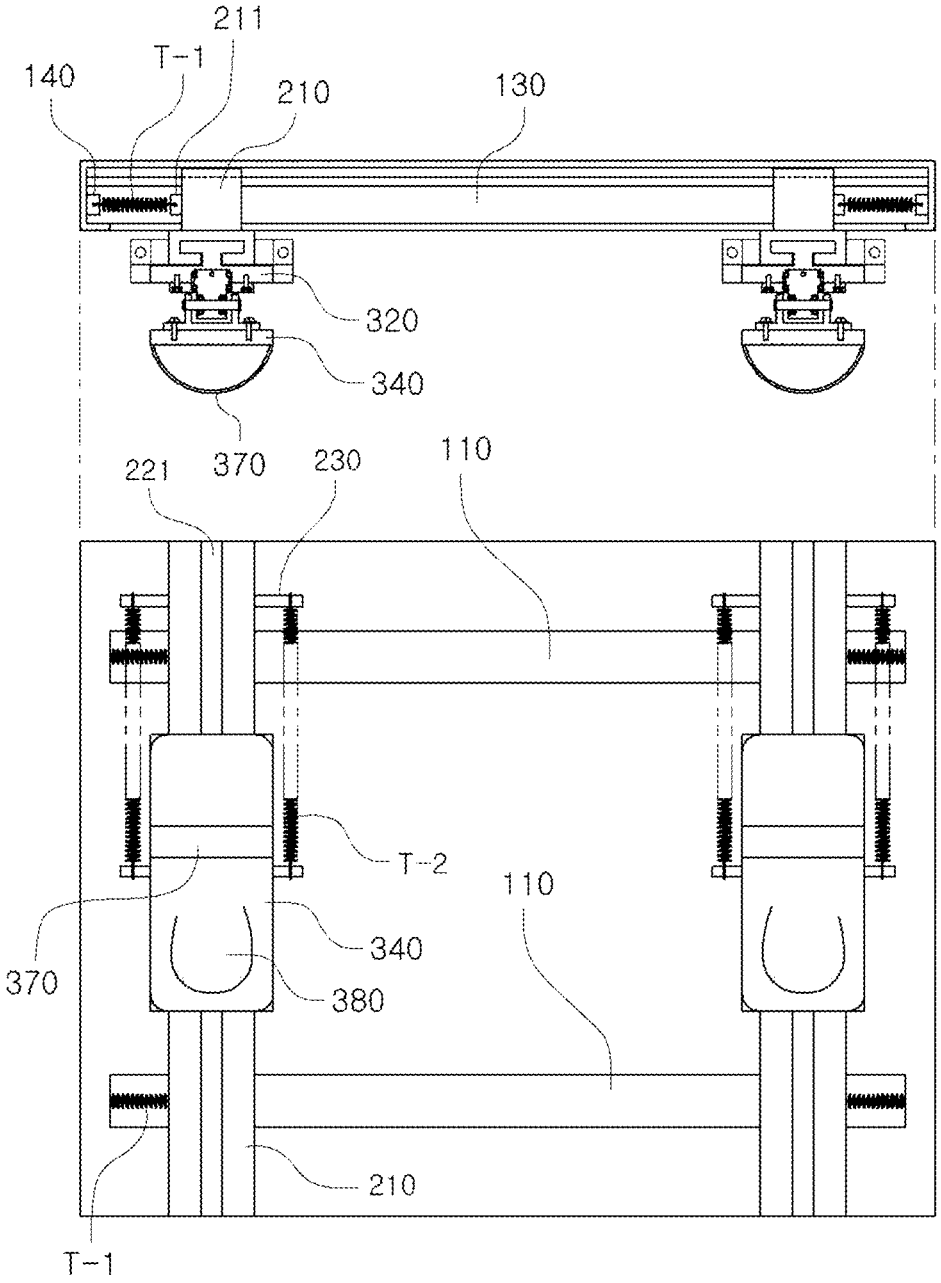
FIG. 3 is a front view and a plan sectional view illustrating the foot board according to the present invention.
Figure 4:
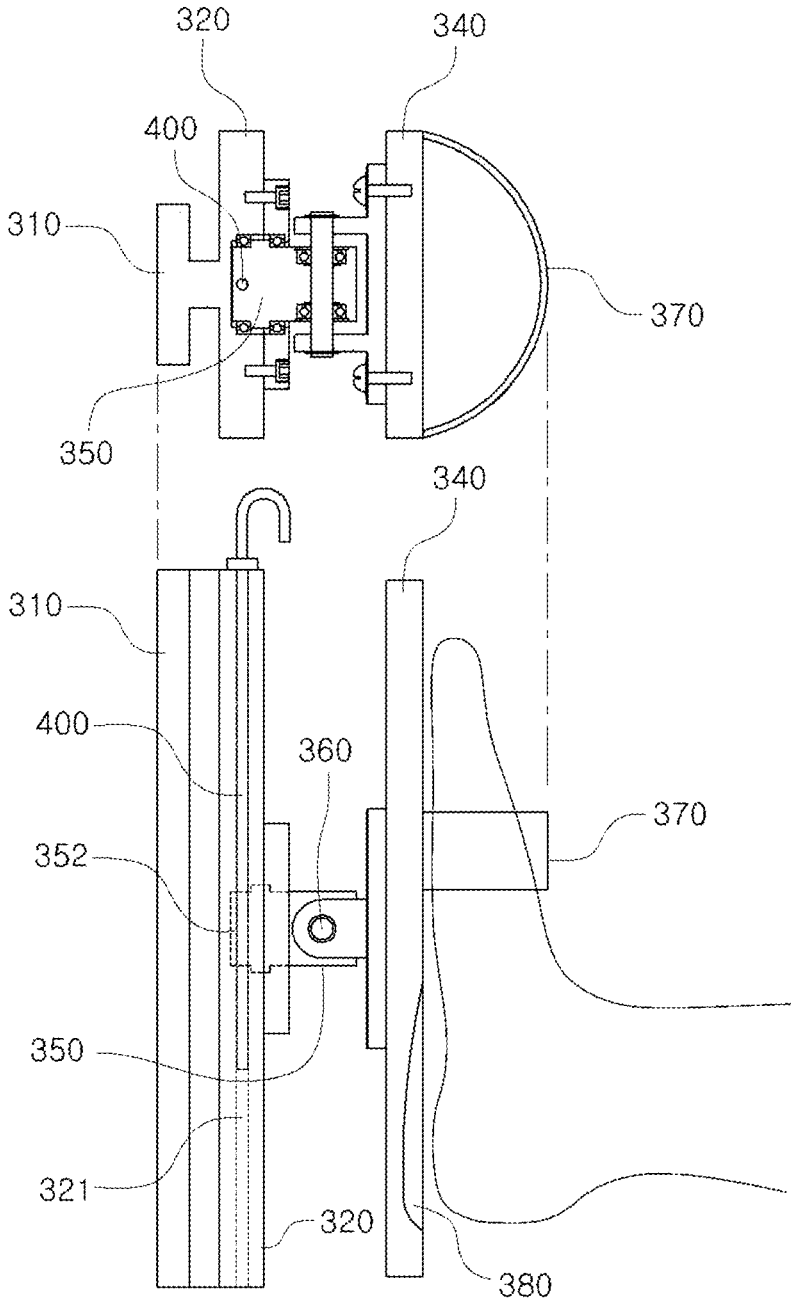
FIG. 4 is a side view and a plan sectional view illustrating a foot pad according to the present invention.
Figure 5:
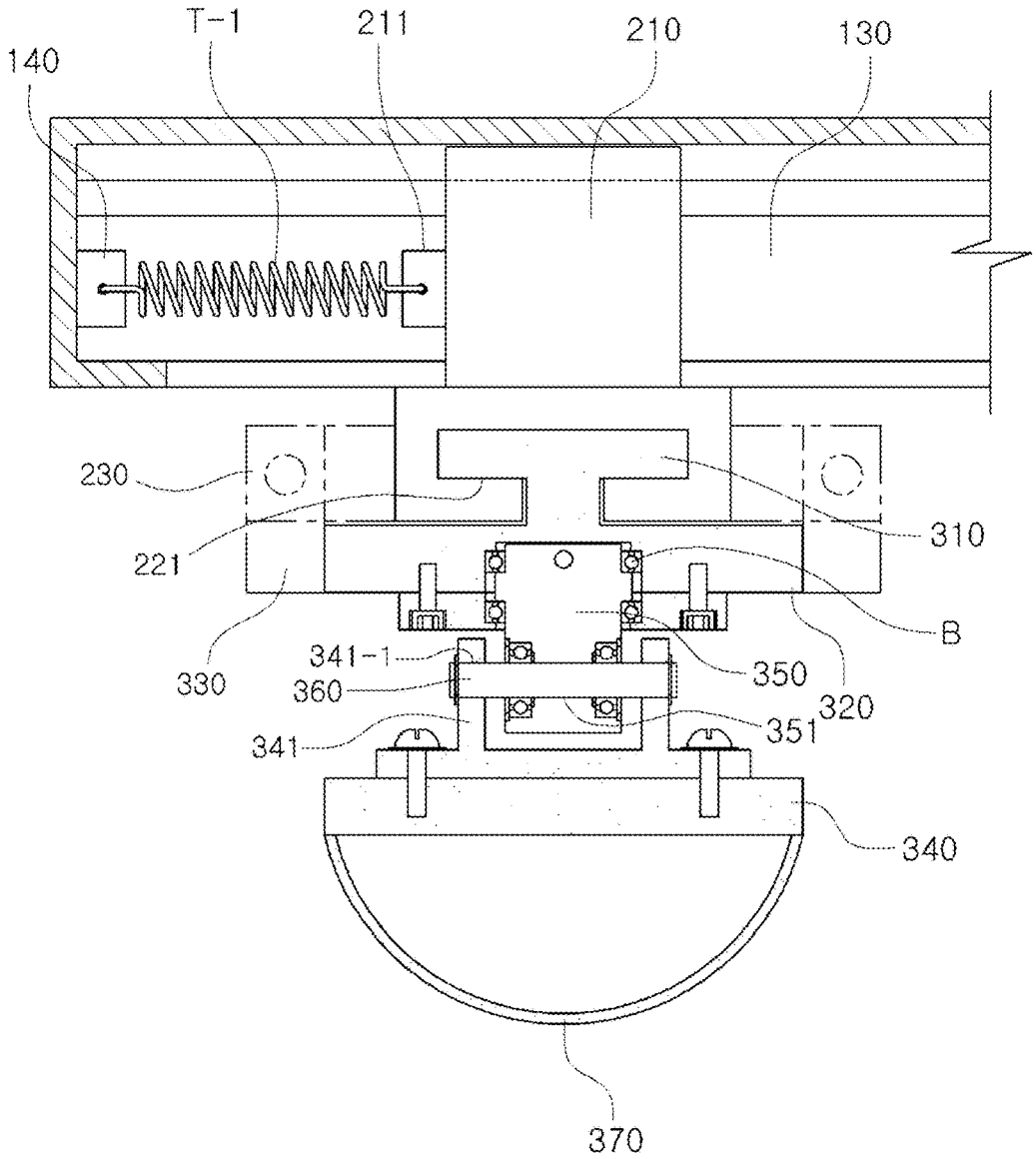
FIG. 5 is a view illustrating the state in which the foot pad according to the present invention is coupled to a slide.
Figure 6:
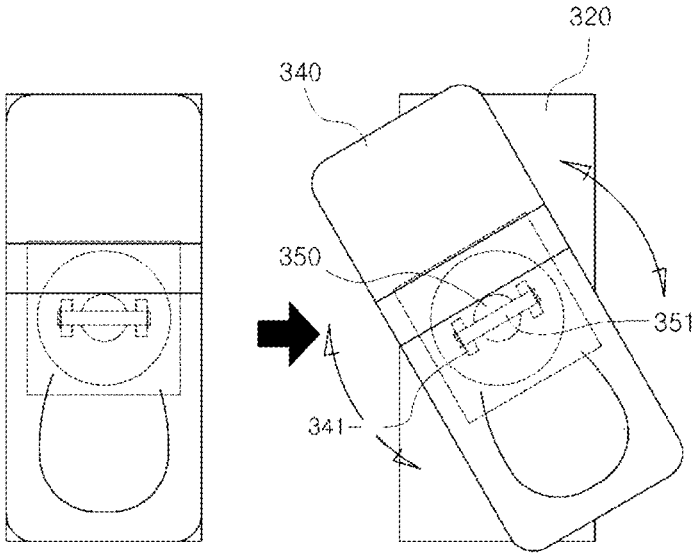
FIG. 6 is a view illustrating the rotation of the foot pad according to the present invention.
Figure 7:
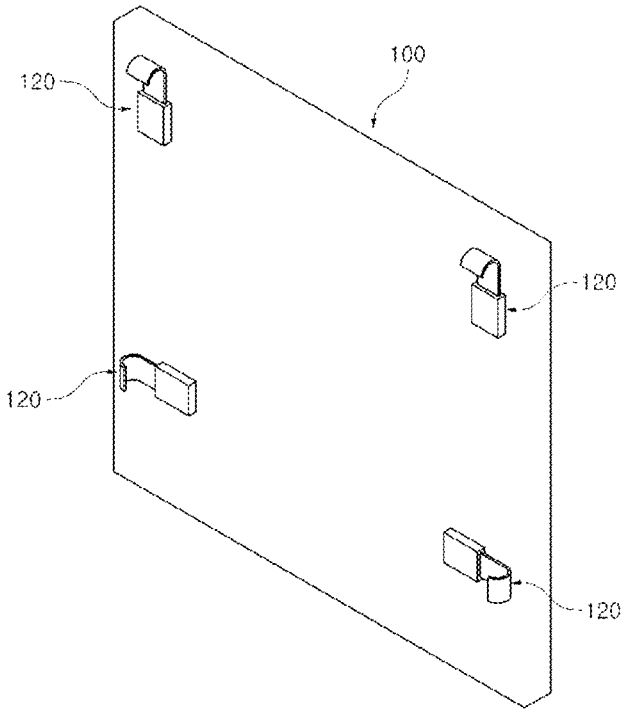
FIG. 7 is a rear perspective view illustrating a board main body, to which fastening members according to the present invention are coupled.

The present invention will be described in detail with reference to the accompanying drawings.

As shown in FIGS. 1 to 10, a kinetic chain energy movement (KEM) board according to the present invention includes a board main body 100, slides 200, and foot pads 300.

The board main body 100 is formed in a flat box shape. The board main body 100 is provided in one side and the other side of the protruding front surface thereof with sliding grooves 110, along which the slides 200 move in the leftward-rightward direction. The sliding grooves 110 extend so as to be parallel to each other in the horizontal direction. The board main body 100 is provided on one side and the other side of the rear surface thereof with fastening members 120, which are detachably fastened to a foot bar 11 or to a footstool board 12 of a Pilates reformer 10.

The board main body 100 is provided in the interior thereof with a space part 130. The space part 130 is provided in each lateral side end thereof with a fixing member 140, by which one end of a first elastic member T-1 is supported. The fixing members 140 are provided in a symmetrical fashion.

The board main body 100 is made of a synthetic resin material or a metal material. Each of the fastening members 120 of the board main body 100 may be of a hook catching type, a Velcro attachment type, a button fastening type, a screw fixing type, or a rubber band binding type.

In a selective embodiment, each of the fastening members 120 includes a hook ring 121, at one side of which a clamp 121-1 is formed. A straight portion 121-2 of the hook ring 121 is mounted in the outermost one of a multistage telescopic withdrawal box 122, i.e. the outermost withdrawal box.

Clamps 122-1 are formed at one side of the multistage telescopic withdrawal box 122 such that, when the withdrawal height or distance of the straight portion 121-2 of the hook ring 121 or the outermost withdrawal box is set, the clamps 122-1 clamp or unclamp the straight portion 121-2 of the hook ring 121 or the outermost withdrawal box at arbitrary positions in order to fix or unfix each of the fastening members 120.

The withdrawal box 122 is configured to telescopically expand and contract in the manner of an antenna. That is, the withdrawal box 122 is configured such that the length of the withdrawal box 122 is increased or decreased.

The straight portion 121-2 of the hook ring 121 is provided with a step projection, which protrudes outward. Consequently, the straight portion 121-2 of the hook ring 121 is freely withdrawn through an opening formed in the outermost withdrawal box. However, the step projection of the straight portion 121-2 of the hook ring 121 is caught by a catching projection defined by the opening, whereby the straight portion 121-2 of the hook ring 121 is prevented from being separated from the outermost withdrawal box. That is, the step projection is provided to prevent the straight portion 121-2 of the hook ring 121 from being separated from the outermost withdrawal box.

In addition, the outermost withdrawal box is configured to be withdrawn from a base withdrawal box, which is larger than the outermost withdrawal box, in a sliding fashion. The outermost withdrawal box is provided at the lower end thereof with a bent projection. Consequently, the bent projection of the outermost withdrawal box is caught by a catching projection of an opening formed in the base withdrawal box, whereby the outermost withdrawal box is prevented from being separated from the base withdrawal box. That is, the bent projection is provided to prevent the outermost withdrawal box from being separated from the base withdrawal box in the same manner as the straight portion 121-2 of the hook ring 121.

In addition, the clamp 122-1, which is formed at the hook ring 121, is fastened to the end of the foot bar 11 or the footstool board 12 of the Pilates reformer 10 in a screw fastening fashion such that the KEM board is prevented from moving after being fastened to the foot bar 11 or the footstool board 12 of the Pilates reformer 10. The clamps 122-1, which are formed at the withdrawal box, are fastened to each of the fastening members 120 in a screw fastening fashion such that each of the fastening members 120 is securely fixed to the foot bar 11 or to the footstool board 12 of the Pilates reformer 10.

That is, the present invention is characterized in that the KEM board according to the present invention can be detachably mounted to all models of Pilates reformers, which may have different standards and dimensions, manufactured by various Pilates reformer manufacturers.

Figure 8:
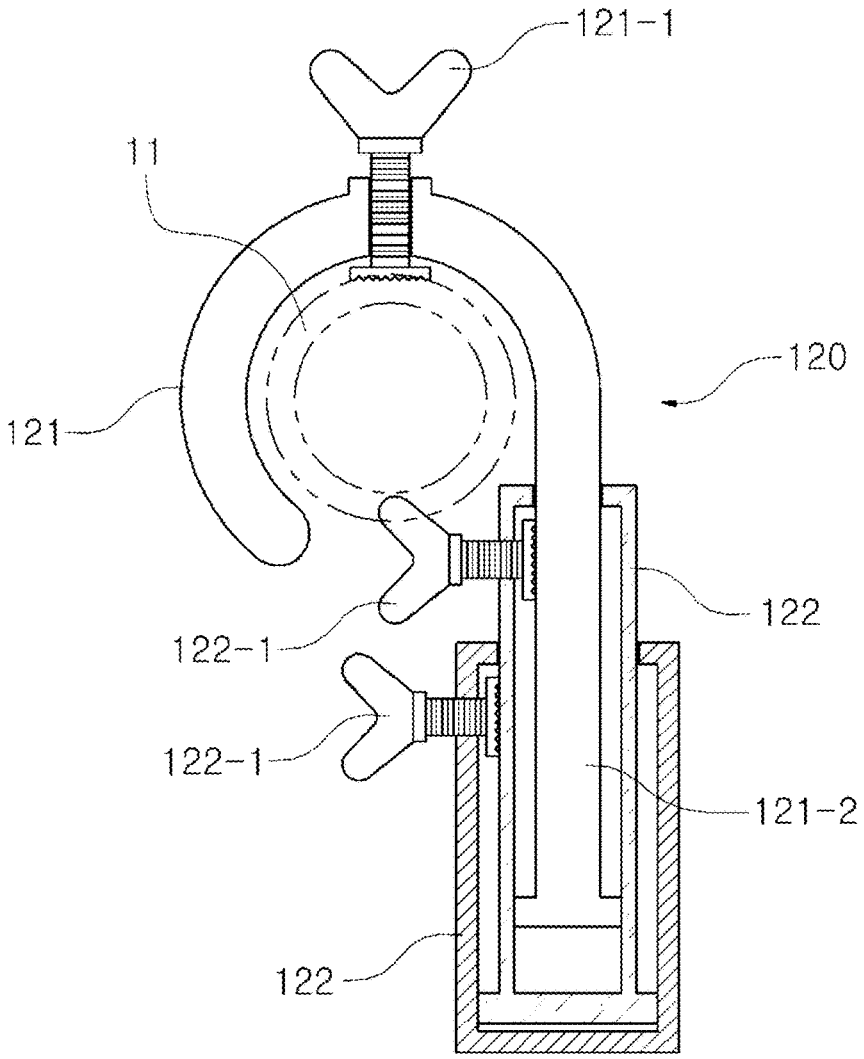
FIGS. 8 and 9 are views illustrating the state in which the fastening member according to the present invention is used.
Figure 9:
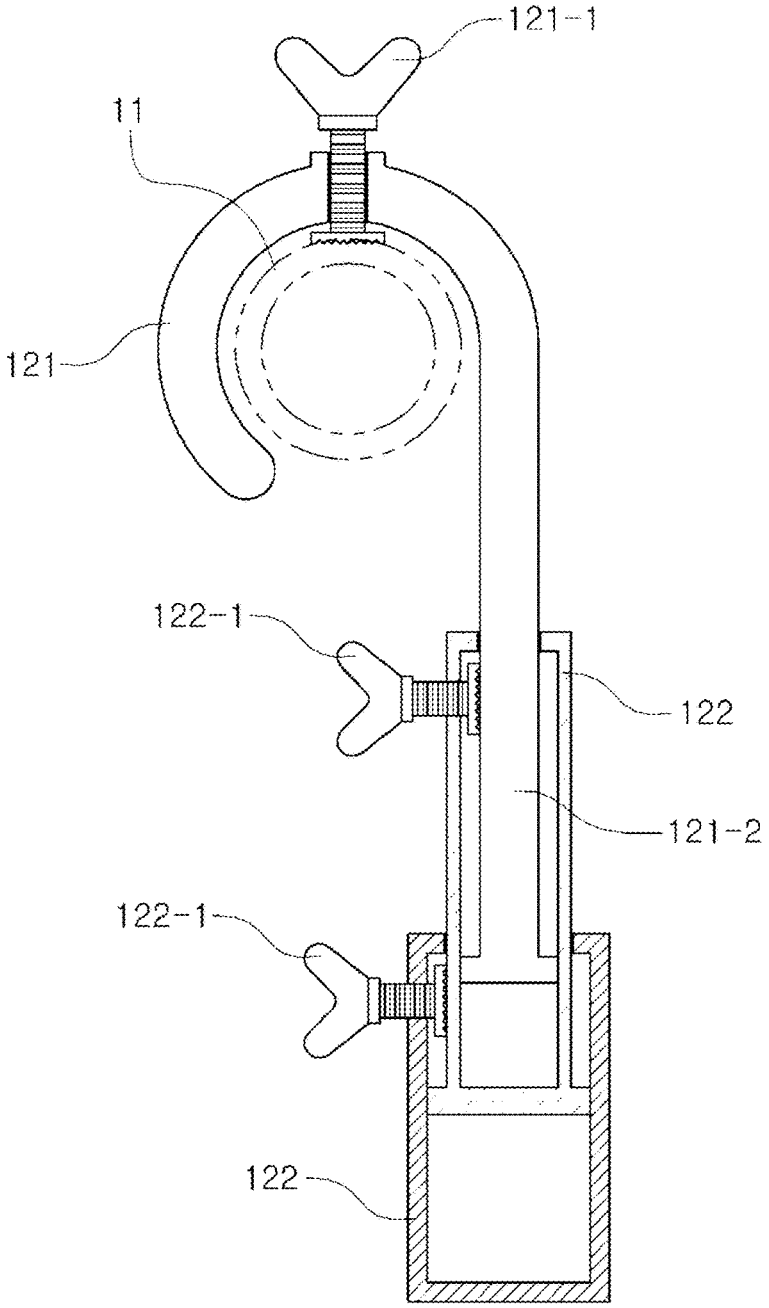
Figure 10:
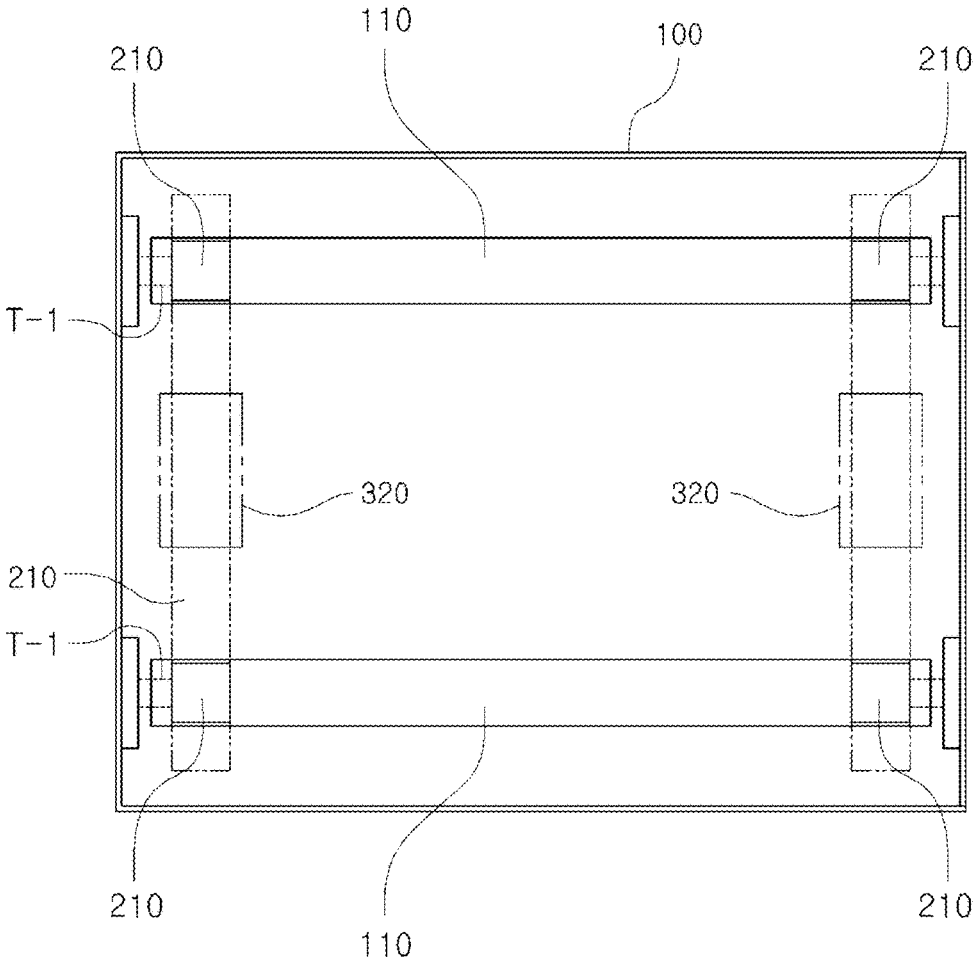
FIG. 10 is a view illustrating the interior of the board main body in which support members according to the present invention are inserted into sliding grooves such that the support members are movable in the leftward-rightward lateral direction.
Figure 11:
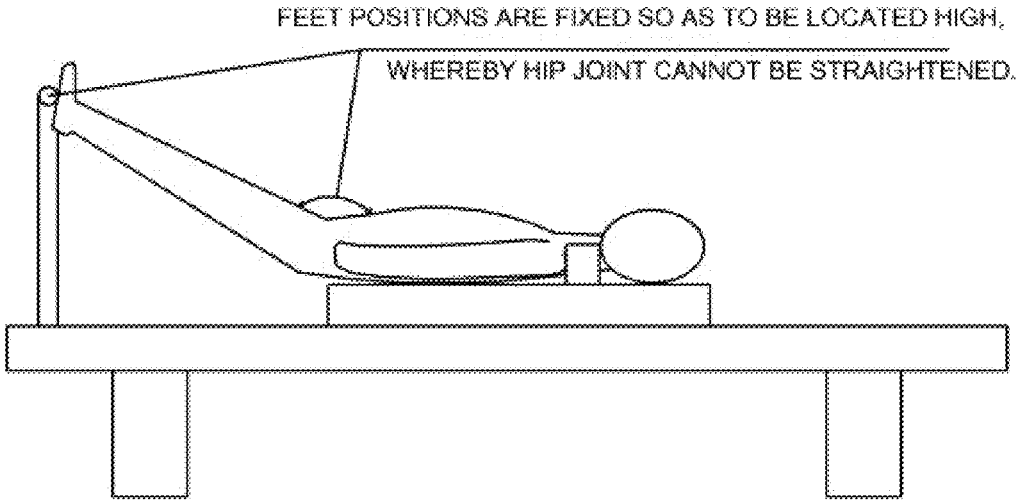
FIGS. 11 to 13 are views illustrating the state in which a conventional Pilates reformer is used.
Figure 12:
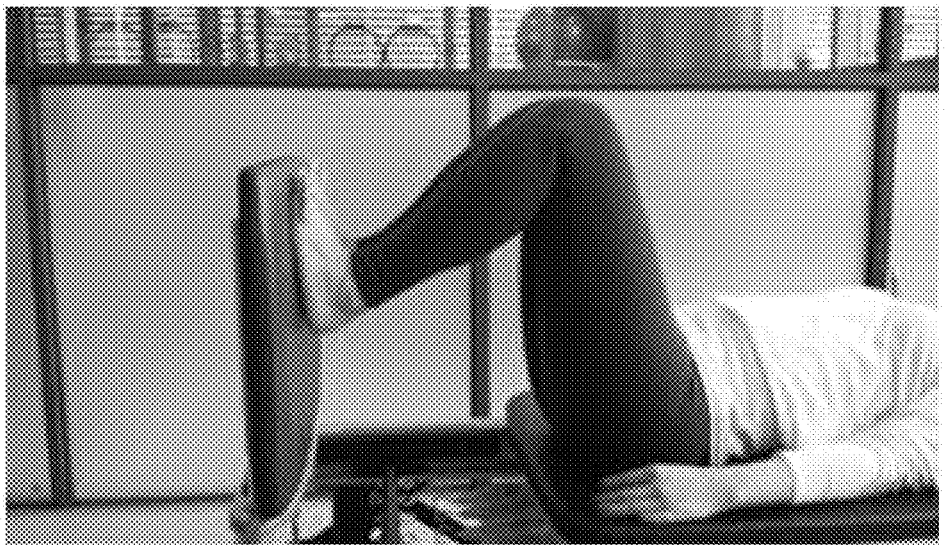
Figure 13:
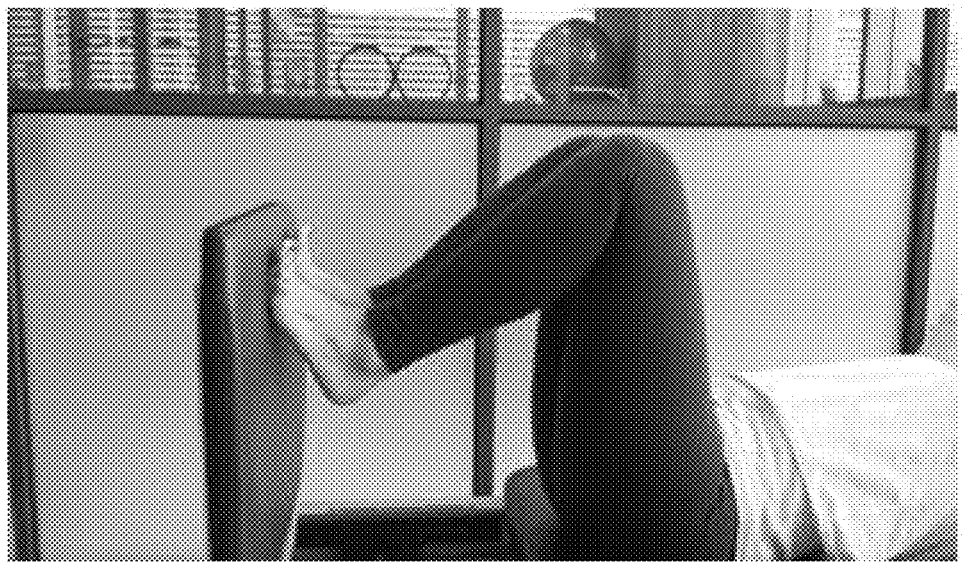

In FIGS. 8 and 9, the clamps 122-1 are shown as being formed at the side at which hook ring 121 is caught. When viewed from the rear surface of the board main body, however, the clamps 122-1 are formed so as to be assembled at the lateral surface of the board main body such that the clamps 122-1 can be fastened to the foot bar 11 or the footstool board 12 of the Pilates reformer 10 or can be unfastened from the foot bar 11 or the footstool board 12 of the Pilates reformer 10.

The withdrawal box, which is provided with the clamps, constitutes an embodiment of each of the fastening members together with the hook ring, which is also provided with the clamp. Alternatively, each of the fastening members may be fastened to the foot bar 11 or the footstool board 12 of the Pilates reformer 10 in a Velcro type male and female (i.e. hook and loop) attachment fashion using pieces of Velcro tape attached to a textile material or a synthetic resin material, in a button fastening fashion using snap buttons attached to a plurality of connection strips, in a through fixing fashion using bolts or screws, or in an elastic binding fashion using a rubber band.

Meanwhile, each of the slides 200 is provided at one side and the other side thereof with support members 210, which are inserted into the respective sliding grooves 110 such that the support members 210 can be moved in the leftward-rightward lateral direction. Each of the support members 210 is provided at one side thereof in the leftward-rightward lateral direction with a connection plate 211, the horizontal axis of which is aligned with the horizontal axis of the fixing member 140 and to which the other end of the first elastic member T-1 is fixed. A vertical bar 220, which is provided with an upward-downward moving rail 221, is formed at the protruding front surface of each of the support members 210. A bracket 230, to which one end of a second elastic member T-2 is fixed, is formed at each side of the upper end of the vertical bar 220.

That is, the support members 210 are configured to slide in the leftward-rightward direction within the horizontal sliding range of each of the slides 200, and a corresponding one of the foot pads 300, a description of which will follow, is mounted in the moving rail 221 of the vertical bar 220 such that the corresponding one of the foot pads 300 can slide in the upward-downward direction. The foot pads 300 may be moved upward, downward, leftward, and rightward as desired by a user. In particular, the foot pads 300 may be moved so as to draw a movement line that traces a circle having a predetermined diameter.

The first elastic member T-1 and the second elastic member T-2 may be made of a coil spring, a rubber band, or an elastic synthetic resin string. The first elastic member T-1 and the second elastic member T-2 may be formed so as to have low, middle, and high degrees of tension such that the first elastic member T-1 and the second elastic member T-2 are interchangeable as desired.

The first elastic members T-1 and the second elastic members T-2 generate elastic force due to the biasing of the foot pads 300 to the left and right side ends of the board main body or to the upper side end of the board main body such that a user pushes his/her feet toward the middle part of the board main body or toward the lower side of the board main body in order to resist the elastic force.

Meanwhile, each of the foot pads 300 is provided at one side thereof with a moving block 310, which is inserted into the moving rail 221 so as to be movable upward and downward. A footstool 320, on which a foot is located, is formed at the protruding front surface of the moving block 310. The footstool 320 is provided at each end thereof in the leftward-rightward lateral direction with a catching member 330, the vertical axis of which is aligned with the vertical axis of the bracket 230 and to which the other end of a corresponding one of the second elastic members T-2 is connected.

In a selective embodiment, each of the foot pads 300 includes a foot pedal 340 coupled to the upper surface of the footstool 320. The foot pedal 340 is provided on the surface thereof opposite the surface that the foot contacts with a fixing rib 341 having therein an assembly hole 341-1. A hinge pin 360 is coupled through the assembly hole 341-1 such that the horizontal axis of an upper connection hole 351 formed in a shaft 350, which extends from the footstool 320 after having been assembled with the footstool 320, is aligned with the horizontal axis of the assembly hole 341-1. As a result, the foot pedal 340 performs a forward-rearward seesaw motion about the hinge pin 360 with respect to the footstool 320.

That is, the foot pedal 340 may perform a seesaw motion when a foot is disposed on the foot pedal 340. Consequently, the foot pedal 340 may be moved almost all the way to the upper end of the board main body. In addition, about half of the foot protrudes outward from the foot pedal 340 at the upper end of the moving rail 221 (at this time, the top side of the foot extends straight), with the result that the ankle moves in the manner of a seesaw, whereby it is possible to perform exercises without a load being applied to the joint.

In a selective embodiment, the foot pedal 340 is formed such that the shaft 350 can be rotated in the circumferential direction in the state of being supported by a bearing B. Consequently, it is possible to perform an arc rotation motion of the feet, including a motion of closing the feet or a motion of opening the feet, in addition to a parallel motion of the feet.

The foot pedal 340 is provided with a rubber band 370 for fixing the top side of the foot and a location recess 380, in which the heel is located. When the foot of the user is located on the foot pedal 340, strong fixing force is generated while tight contact between the foot and the foot pedal 340 is achieved.

As needed, the heel may be wound by a sandal string, instead of the location recess 380. Of course, the heel may be wound by a sandal string in the state in which the location recess 380 is formed.

In a selective embodiment, the shaft 350 is provided in the side surface thereof that is assembled to the footstool 320 with a fixing hole 352. The fixing hole 352 is formed so as to communicate with an insertion hole 321 formed in the footstool 320. When a stopper pin 400 is inserted into the fixing hole 352 via the insertion hole 321, therefore, the circumferential rotation of the shaft 350, performed in the state of being supported by the bearing B, may be prevented.

The stopper pin 400 may be provided at the upper side end thereof with a bent handle, through the use of which the stopper pin 400 may be easily inserted into or removed from the fixing hole 352.

That is, the stopper pin is provided to selectively perform the rotation of the foot pedal. As needed, the stopper pin may be replaced by another fixing device, such as a clip or button fixing device. When the stopper pin or the other fixing device is removed, rotation of the foot pedal is possible. As a result, the parallel motion of the feet or the arc motion of the feet may be selectively performed.

As can be seen from the above description, the prevent invention is provided to solve the problem with the conventional Pilates reformer in that the range of motion is limited and to enable a greater variety of motions to be performed, thereby maximizing the physical reforming effect, which is the main object of the Pilates exercise.

That is, the foot pedals, on which the feet are placed, may be moved almost all the way to the upper end of the board main body through the slides. In particular, about half of the foot protrudes outward from the foot pedal at the upper end of the vertical bar according to a seesaw principle or a seesaw motion (i.e. the foot pedal protrudes outward from the board, with the result that the top side of the foot is arranged in the same line as the leg in the state in which the ankle and the hip joint are movable within a greater range of motion in a safe state), whereby exercises can be performed.

The feet can move as a seesaw, with the result that the hip joint is movable within the full range of motion without a load being applied to the ankle joint.

In addition, the foot pedal can be moved in all directions, including the forward-rearward direction and the circumferential direction, with the result that the hip joint is movable so as to perform various motions, including a circular motion.

According to the present invention, the weight of the user may be appropriately distributed to the front and the rear of the foot. In addition, the balance of the ankle joint in the forward-rearward direction may be improved, and the proprioceptor may be stimulated. Furthermore, since the foot pedal, on which the foot is placed, is rotated, it is possible to check the extent to which the foot is turned and deviates from an ideal arrangement of the leg or the knee while exercising. Moreover, it is possible to learn the proper arrangement of the foot, the knee, and the hip joint.

In addition, the KEM board according to the present invention includes sliding grooves, moving rails, and foot pads (including foot pedals) configured to be moved upward, downward, leftward, and rightward by the first and second elastic members. Consequently, it is possible to activate adductor thigh muscles, which are muscles that closes the legs, in response to the force by which the feet are opened and to achieve eccentric contraction of the hamstring muscles, which are the muscles that push the legs downward, the gluteal muscles, and the Achilles tendons, in response to the upward pulling force that is generated as the motion in the upward-downward moving rail.

For reference, the present invention has been made in view of anatomy trains, which have attracted consideration in recent years. In anatomy trains, muscle trains start from the feet, and therefore the close kinematic chain (CKC) motion using the footstool is critical in Pilates exercises, which are performed to achieve changes in posture.

As is apparent from the above description, the present invention provides a detachable kinetic chain energy movement (KEM) board for posture when using a Pilates reformer, which is configured to be detachably mounted to a foot bar or a footstool board of the Pilates reformer in order to provide flexion and extension, which are not conventionally possible, wherein the KEM board is configured to be easily and conveniently mounted to and detached from all kinds of Pilates reformers, is configured to derive much better muscle exercise effects during reformer exercises through the motion of the ankle and the hip joint within a full range of motion (ROM) and elastic resistance, and is configured to enable various kinds of exercises to be performed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A detachable kinetic chain energy movement (KEM) board for posture when using a Pilates reformer, the KEM board comprising:

a board main body provided in one side and the other side of a front surface thereof with sliding grooves for movement in a leftward-rightward direction, the sliding grooves extending so as to be parallel to each other in a horizontal direction, the board main body being provided on one side and the other side of a rear surface thereof with fastening members, which are detachably fastened to a foot bar or a footstool board of the Pilates reformer, the board main body being provided in an interior thereof with a space part, the space part being provided in each lateral side end thereof with a fixing member, by which one end of a first elastic member is supported, the fixing members being provided in a symmetrical fashion;

slides, each of the slides being provided at one side and the other side thereof with support members, which are inserted into the respective sliding grooves such that the support members are movable in a leftward-rightward lateral direction, each of the support members being provided at one side thereof in the leftward-rightward lateral direction with a connection plate, a horizontal axis of which is aligned with a horizontal axis of the fixing member and to which the other end of the first elastic member is fixed, a vertical bar, which is provided with an upward-downward moving rail, being formed at a protruding front surface of each of the support members, a bracket, to which one end of a second elastic member is fixed, being formed at each side of an upper end of the vertical bar; and foot pads, each of the foot pads being provided at one side thereof with a moving block, which is inserted into the moving rail so as to be movable upward and downward, a footstool, on which a foot is located, being formed at a protruding front surface of the moving block, the footstool being provided at each end thereof in the leftward-rightward lateral direction with a catching member, a vertical axis of which is aligned with a vertical axis of the bracket and to which the other end of the second elastic member is connected.

2. The KEM board according to claim 1, wherein each of the fastening members of the board main body is one of a hook, a tape, a button, a screw, and a rubber band.

3. The KEM board according to claim 1, wherein each of the fastening members of the board main body comprises a hook ring, at one side of which a clamp is formed, a straight portion of the hook ring being mounted in an outermost withdrawal box, clamps being formed at one side of the multistage telescopic withdrawal box such that, when a withdrawal height or distance of the straight portion of the hook ring or the outermost withdrawal box is set, the clamps clamp or unclamp the straight portion of the hook ring or the outermost withdrawal box at arbitrary positions in order to fix or unfix each of the fastening members.

4. The KEM board according to claim 1, wherein the first elastic member and the second elastic member are made of any one selected from among a coil spring, a rubber band, and an elastic synthetic resin string, and wherein the first elastic member and the second elastic member are formed so as to have low, middle, and high degrees of tension such that each of the first elastic member and the second elastic member is interchangeable.

5. The KEM board according to claim 1, wherein each of the foot pads comprises a foot pedal coupled to an upper surface of the footstool, the foot pedal being provided on a surface thereof opposite a surface that the foot contacts with a fixing rib having therein an assembly hole, a hinge pin being coupled through the assembly hole such that a horizontal axis of an upper connection hole formed in a shaft, which extends from the footstool after having been assembled with the footstool, is aligned with a horizontal axis of the assembly hole, whereby the foot pedal performs a forward-rearward seesaw motion about the hinge pin with respect to the footstool.

6. The KEM board according to claim 5, wherein the foot pedal is formed such that the shaft is rotatable in a circumferential direction in a state of being supported by a bearing, whereby it is possible to perform an arc rotation motion of feet, comprising a motion of closing the feet or a motion of opening the feet, in addition to a parallel motion of the feet.

7. The KEM board according to claim 6, wherein the shaft is provided in a side surface thereof that is assembled to the footstool with a fixing hole, the fixing hole being formed so as to communicate with an insertion hole formed in the footstool, whereby circumferential rotation of the shaft, performed in the state of being supported by the bearing, is prevented when a stopper pin is inserted into the fixing hole via the insertion hole.

* * * * *